US005167999A

United States Patent [19]

Wang

[11] Patent Number: 5,167,999

[45] Date of Patent: Dec. 1, 1992

[54] LIQUID CUSHIONING MEANS

[76] Inventor: Sui-Mu Wang, c/o Hung Hsing Patent Serivce Center P.O. Box 55-1670, Taipei, Taiwan

[21] Appl. No.: 716,993

[22] Filed: Jun. 18, 1991

[51] Int. Cl.[5] ..... B32B 1/00; A47C 27/08; A43B 13/38

[52] U.S. Cl. ..... 428/178; 428/155; 428/172; 428/192; 5/451; 5/644; 36/30 R; 36/43; 36/44

[58] Field of Search ..... 428/178, 179, 72, 76, 428/119, 120, 131, 134, 136, 137, 138, 155, 157, 166, 172, 192; 5/441, 449, 450, 451; 36/29, 30 R, 35 R, 43, 44

[56] References Cited

U.S. PATENT DOCUMENTS 4,422,194 12/1983 Viesturs ..... 5/451

*Primary Examiner*—Donald J. Loney

[57] ABSTRACT

A cushioning device includes a plurality of liquid cells encapsulated in a flexible substrate sheet wherein each liquid cell is filled with water therein and the cells are juxtapositionally disposed on the sheet so that a cellular sheet may serve as a cushioning device for a user's seating, leaning or wearing for comfortable cushioning purposes.

2 Claims, 4 Drawing Sheets

LIQUID CUSHIONING MEANS

BACKGROUND OF THE INVENTION

A conventional packing sheet or cloth may be formed with a plurality of cells filled with air in each cell on a substrate film or sheet material. Such a cellular packing sheet may be used for packing articles in the sheet to prevent damage or breakage of the articles to be packed. However, if such a packing sheet with air cells formed on the sheet is used for cushioning device such as for serving as an insole used in a footwear or for cushioning a user's body for leaning, seating or wearing purpose, the air-filled cells may be easily broken to lose their cushioning effect.

If a substrate sheet is formed with a plurality of protrusions on the sheet such as by integral molding of plastic processing, the protrusions may still have some hardness or rigidity to possibly stick a user to cause his or her pain when wearing, seating or leaning on such a sheet with protrusions formed thereon.

The present inventor has found the drawbacks of the conventional cushioning sheet, and invented the present cushioning device having liquid cells formed thereon.

SUMMARY OF THE INVENTION

The object of the present invention is to provide a cushioning device including a plurality of liquid cells encapsulated in a flexible substrate sheet wherein each liquid cell is filled with water therein and the cells are juxtapositionally disposed on the sheet so that a cellular sheet may serve as a cushioning device for a user's seating, leaning or wearing for comfortable cushioning purposes.

DETAILED DESCRIPTION

Figure 1:
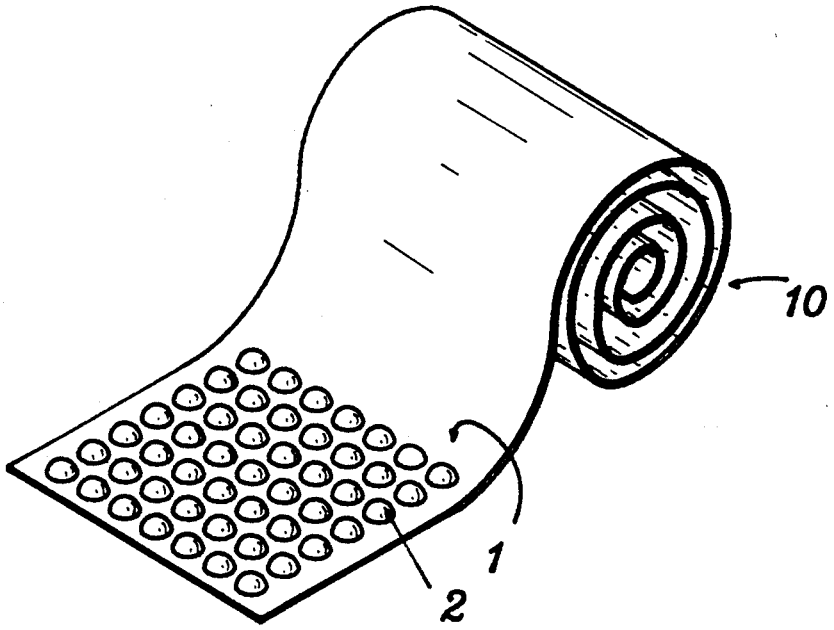
FIG. 1 is a perspective view of the present invention unwound from a roll.
Figure 2:
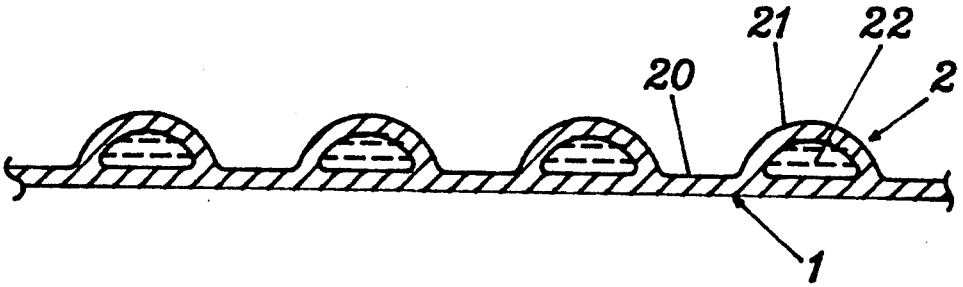
FIG. 2 is a sectional drawing of the present invention.

As shown in FIGS. 1, 2, the present invention comprises: a substrate sheet 1, and a plurality of liquid cells 2 juxtapositionally formed on the sheet 1.

The substrate sheet 1 may be made of flexible plastic material and may be wound after being integrally formed with the plurality of liquid cells 2 on the sheet 1 to form a roll 10 as shown in FIG. 1, which can be unwound to be cut to a predetermined length for its end use.

Each liquid cell 2 includes: a convex surface layer 21 integrally formed on the substrate sheet 1 for encapsulating a liquid 22 in the cell 2 between the convex surface layer 21 and the substrate sheet 1. The liquid 22 is not limited in this invention, and is preferably selected from water.

The shape of each cell 2 is not limited in this invention, which can be circular, spherical, cylindrical, elliptic, oval, rectangular, conical, short strip or long strip or any other shapes or structures regular or irregular.

Figure 3:
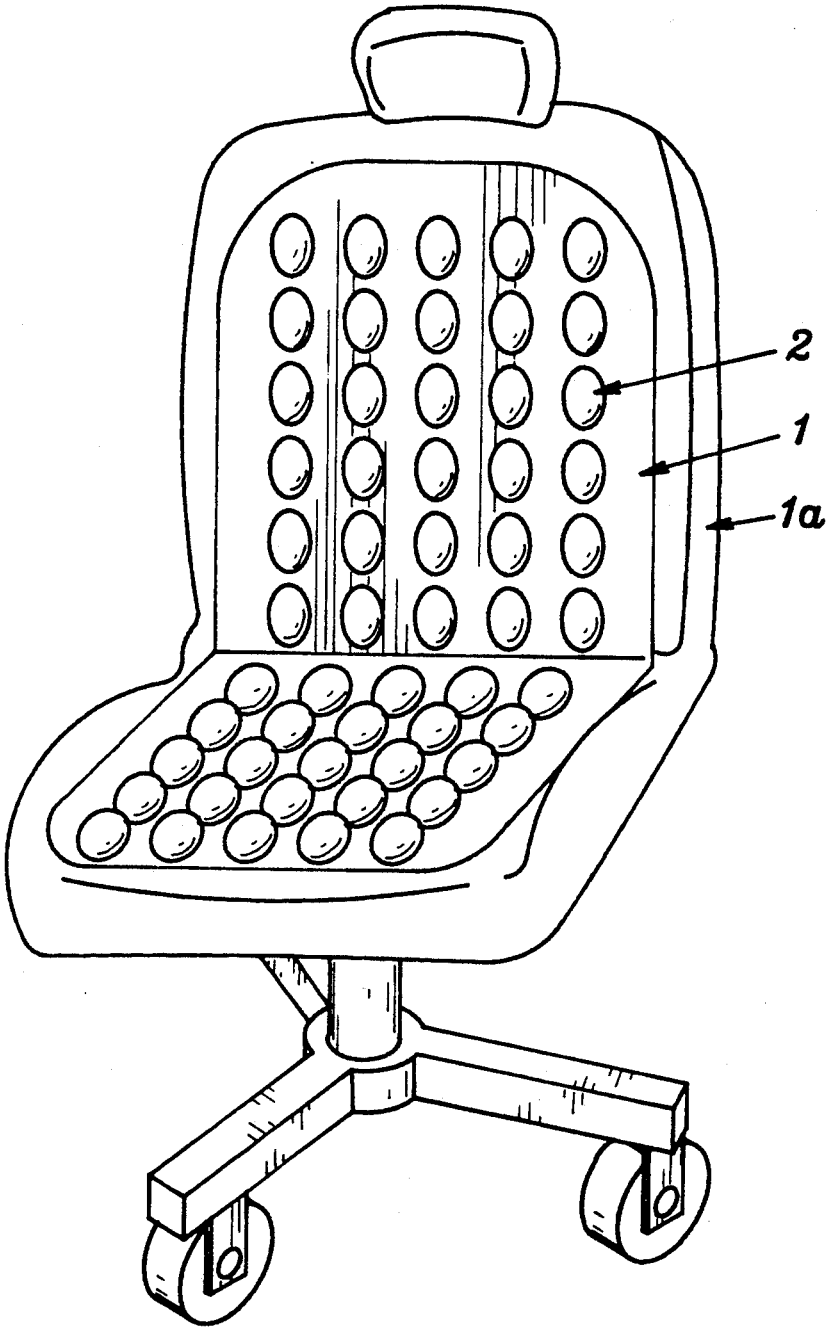
FIG. 3 is a perspective view showing an application of the present invention.

The sheet 1 with the cells 2 may be made as a cushioning pad secured on a chair 1*a* for comfortably cushioning a user's seating or leaning on the cushioning means of this invention as shown in FIG. 3.

Figure 4:
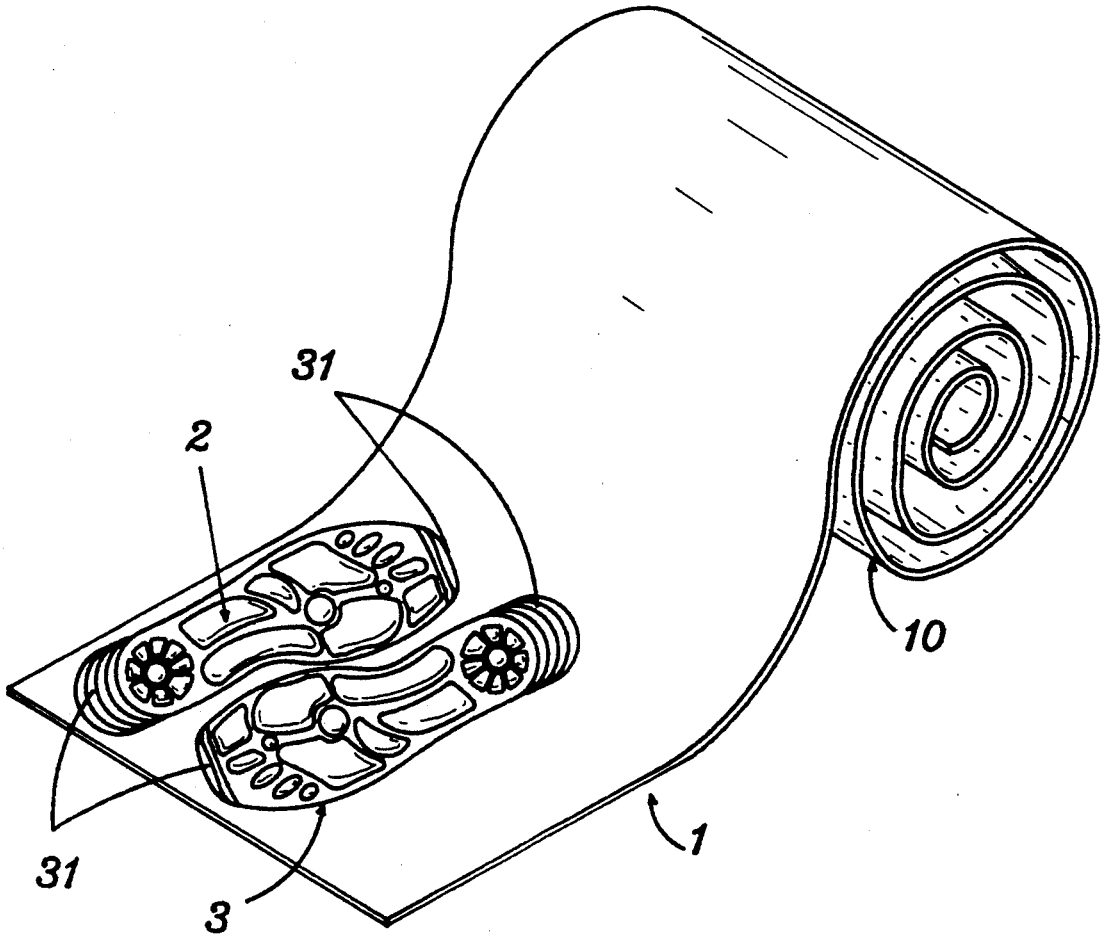
FIG. 4 shows another preferred embodiment of the present invention when unwound from a roll in which only two inner soles are shown.
Figure 5:
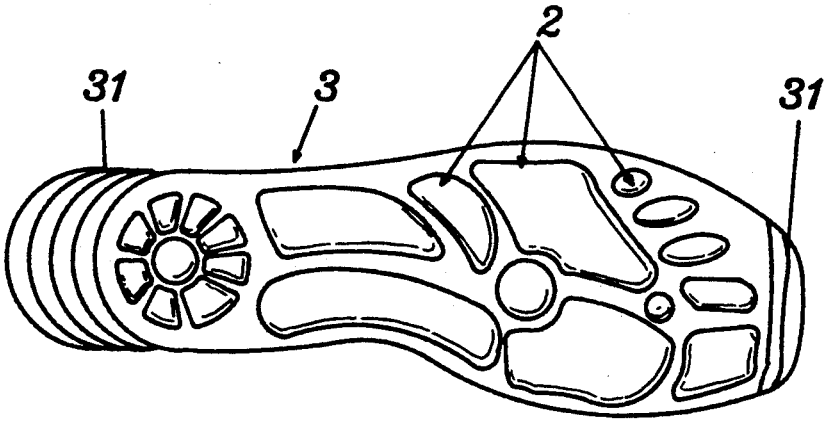
FIG. 5 is a plan view of the present invention for use as an insole when cut from a sheet.

As shown in FIGS. 4, 5, the present invention may be formed as a foot shape having a contour line 3 notched in the sheet 1 formed with the plurality of liquid cells 2 thereon so that the contour line 3 can be cut by a cutter to form an insole as shown in FIG. 5. Still, a plurality of cutting lines 31 may be juxtapositionally notched in a front and rear edge of the insole 3 as shown in FIG. 5 which can be cut to a suitable size adapted for a user's proper wearing.

Figure 6:
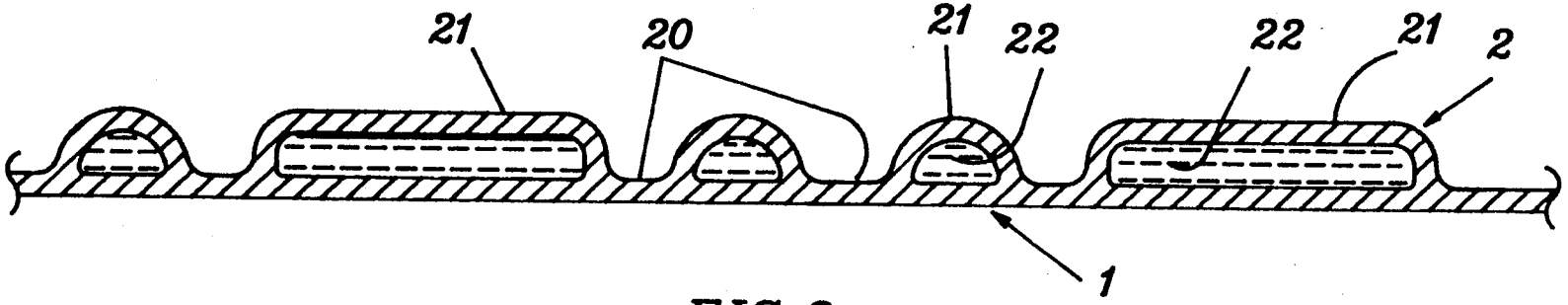
FIG. 6 is a sectional drawing of the present invention having each cell convexly formed on a single side of a substrate sheet.
Figure 7:
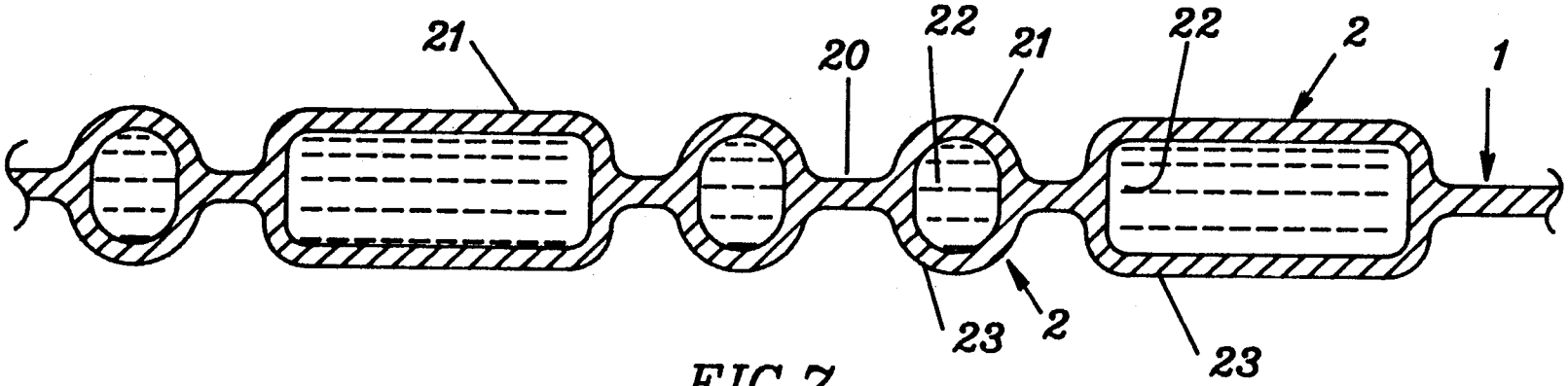
FIG. 7 is a sectional drawing of the present invention showing two surface layers of each cell convexly formed on two opposite sides of a substrate sheet.

The liquid cell 2 formed on the substrate sheet 1 of the present invention may include a single surface layer 21 convexly formed on a single side of the substrate sheet 1 as shown in FIGS. 2 and 6. Also, two surface layers 21 may be convexly formed on two opposite sides of the substrate sheet 1 as shown in FIG. 7.

Since the liquid cells 2 of the present invention are filled with liquid such as water in each cell 2, the substrate sheet 1 will serve as an effective cushioning device for comfortable cushioning uses, such as for: seating, leaning, wearing purposes, or even for massaging use.

During a cushioning service by the present invention, a plurality of apertures 20 defined among the cells 2 will serve as air ventilating passages for cooling purpose.

Therefore, the present invention is superior to a conventional cushioning device with the following advantages:

1. The cells 2 formed on the substrate sheet 1 are filled with water to exert a better elasticity than hard plastic protrusions formed on a conventional hard sheet and even better than a conventional sheet formed with air cells since air is compressible and upon a pressure loaded on the cells the air cells will be compressed to collapse, thereby impairing their elasticity.

2. The water filled in the cells 2 may provide a cooling effect in a hot weather season or environment for enhancing a comfortable cushioning purpose for the user.

3. The sound elasticity of the water-filled cells 2 may cause the cushioning device to be stronger and will not be easily broken in comparison with those packaging film formed with air cells.

The liquid cells 2 may be independently formed on the sheet 1 or may be partially communicated with one another among those partially connected cells.

I claim:

1. A liquid cushioning means comprising:

a substrate sheet made of flexible sheet material: and a plurality of liquid cells juxtapositionally formed on said substrate sheet, each said liquid cell filled with a liquid therein and having a surface layer convexly formed on said substrate sheet encapsulating the liquid in said cell between said surface layer and said substrate sheet; at least an aperture defined among said liquid cells disposed on said substrate sheet;

the improvement which comprises:

said substrate sheet including at least a notched contour line notched in said substrate sheet corresponding to a cushioning article having a plurality of said liquid cells formed on said substrate sheet confined within said notched contour line, said notched contour line of said substrate sheet confining a plurality of cutting lines juxtapositionally notched in an edge portion inwardly within said contour line, each said cutting line operatively cut in respect of a desired size of said cushioning article formed in said sheet to severably obtain said cushioning article as cut from said substrate sheet.

2. A liquid cushioning means according to claim 1, wherein each said cushioning article is individually formed on said substrate sheet by integrally forming a plurality of said liquid cells on said substrate sheet having a contour line of said sheet matching with an outer edge of the cushioning article.

* * * * *